US011713222B2

(12) United States Patent
Schoonmaker et al.

(10) Patent No.: US 11,713,222 B2
(45) Date of Patent: Aug. 1, 2023

(54) SYSTEM AND METHOD FOR MONITORING CRANE AND CRANE HAVING SAME

(71) Applicant: Manitowoc Crane Companies, LLC, Milwaukee, WI (US)

(72) Inventors: Stephen J. Schoonmaker, Chambersburg, PA (US); John F. Benton, Smithsburg, MD (US); Michael Stake, Chambersburg, PA (US)

(73) Assignee: Manitowoc Crane Companies, LLC, Milwaukee, WI (US)

( * ) Notice: Subject to any disclaimer, the term of this patent is extended or adjusted under 35 U.S.C. 154(b) by 0 days.

(21) Appl. No.: 17/124,471

(22) Filed: Dec. 16, 2020

(65) Prior Publication Data

US 2021/0179396 A1 Jun. 17, 2021

Related U.S. Application Data

(60) Provisional application No. 62/948,795, filed on Dec. 16, 2019, provisional application No. 62/948,799, filed on Dec. 16, 2019.

(51) Int. Cl.
*B66C 23/90* (2006.01)
*B66C 13/16* (2006.01)
(Continued)

(52) U.S. Cl.
CPC ..... *B66C 23/905* (2013.01); *B66C 13/16* (2013.01); *B66C 13/48* (2013.01); *B66C 23/42* (2013.01);
(Continued)

(58) Field of Classification Search
CPC ..... B66C 13/16; B66C 13/48; B66C 23/88; B66C 23/905
See application file for complete search history.

(56) References Cited

U.S. PATENT DOCUMENTS 5,251,768 A 10/1993 Yoshimatsu et al.
8,272,521 B1 9/2012 Kemmerly et al.
(Continued)

FOREIGN PATENT DOCUMENTS

DE 102017202009 A1 9/2017
WO 2014138801 A1 9/2014

OTHER PUBLICATIONS

DE 102017202009 A1 Machine Translation (Year: 2017).*
International Search Report issued in counterpart application No. PCT/US2020/065438 dated Apr. 29, 2021, 12 pages.

*Primary Examiner* — Michael R Mansen
*Assistant Examiner* — Juan J Campos, Jr.
(74) *Attorney, Agent, or Firm* — Cook Alex Ltd.

(57) ABSTRACT

A crane includes a carrier unit having a chassis, tires connected to the chassis, a carrier deck and outriggers. A superstructure is mounted on the carrier unit, the superstructure includes a telescoping boom. A slope sensor is operably connected to the carrier unit and configured to detect a pitch and/or a roll of the carrier unit during a lift operation. The crane further includes a system for monitoring a load lifted by the telescoping boom. The system is configured to determine the current load lifted by the telescoping boom, receive pitch and/or roll information of the carrier unit from the slope sensor, adjust coordinates of the crane in a coordinate system based on the pitch and/or roll information, determine a transformed operating radius using the adjusted coordinates; and compare the load lifted to a rated capacity at the transformed operating radius.

10 Claims, 8 Drawing Sheets

(51) Int. Cl.

| | |
|---|---|
| ***B66C 13/48*** | (2006.01) |
| ***B66C 23/88*** | (2006.01) |
| ***B66C 23/42*** | (2006.01) |
| *B66C 23/78* | (2006.01) |

(52) U.S. Cl.
CPC ..... *B66C 23/88* (2013.01); *B66C 23/78* (2013.01); *B66C 2700/0371* (2013.01); *B66C 2700/0378* (2013.01)

(56) References Cited

U.S. PATENT DOCUMENTS

| | | | |
|---|---|---|---|
| 8,694,204 | B2 | 4/2014 | Reeb et al. |
| 2019/0011933 | A1 | 1/2019 | Stacy, II |

* cited by examiner

SYSTEM AND METHOD FOR MONITORING CRANE AND CRANE HAVING SAME

BACKGROUND

The following description relates generally to a crane and a system and method for monitoring the crane.

The rated capacity of a crane refers to a maximum total load the crane is designed to lift in a particular configuration. The particular configuration includes parameters which remain substantially constant during a lift operation, such as the weight of a counterweight and outrigger extension length, and parameters which may vary during the lift operation, such as an operating radius (i.e., the moment arm of the load suspended from the boom) and a swing angle (i.e., a rotational position of a boom relative to a reference point of a carrier unit of the crane in a horizontal plane). The operating radius varies with changes in boom length (for example, in response to extension or retraction of a telescoping boom) and lift angle (i.e., the angle between the boom and the horizontal plane). In general, as the operating radius increases, a load moment increases and the rated capacity decreases. Conversely, as the operating radius decreases, the load moment decreases and the rated capacity increases. To this end, load charts are provided which indicate the rated capacity at different operating radii and/or lift angles.

A conventional crane Rated Capacity Limiter (RCL) system is configured to monitor a current load lifted by the crane and the current operating radius, for example, based on information received from one or more crane sensors and/or operator input. For example, the conventional crane RCL system may determine the current load based at least in part on information received from a pressure sensor detecting hydraulic pressure in a lift cylinder supporting the boom. The current operating radius may be determined based at least in part on information received from a sensor detecting a length of the boom and a sensor detecting the lift angle of the boom.

The conventional crane RCL system is further configured to determine an operating condition of the crane and may control crane operations based on the operating condition. For example, the conventional crane RCL system may control the boom to prevent movement of the current load to an operating radius where the current load exceeds the rated capacity.

A mobile crane typically includes a plurality tires for rolling contact with a support surface such that the crane may be self-propelled for transport on a road or at a worksite. The mobile crane also includes outriggers which can be deployed to engage the ground, lift the tires from the ground and support the mobile crane during a lift operation.

It may be desirable to perform a lift operation for a relatively lightweight load without deploying the outriggers, such that the crane is supported on its tires during the lift operation. However, the crane may be susceptible to deflection in the direction of the load due to compression of the tires. Such deflection has the result of increasing the operating radius without changing a lift angle or boom length. Thus, the conventional RCL system does not detect the change in operating radius. Consequently, the conventional RCL system may compare the current load to a rated capacity in a load chart at a smaller operating radius than the current operating radius, which may affect accuracy of the comparison.

Accordingly, it is desirable to provide a crane and a system and method for the controlling crane in which deflection of a carrier unit is accounted for when monitoring the current load and the current operating radius.

SUMMARY

In one aspect, a crane includes a carrier unit having a chassis, tires connected to the chassis, a carrier deck and outriggers, the outriggers movable to a deployed condition in which the outriggers engage an underlying support surface and lift the tires from the support surface such that the outriggers support the carrier unit, and a retracted condition in which the outriggers are disengaged from the support surface and the tires are engaged with the support surface, such that the tires support the carrier unit. The crane further includes a superstructure mounted on the carrier unit, the superstructure having a telescoping boom, and a slope sensor operably connected to the carrier unit and configured to detect a pitch and/or a roll of the carrier unit during a lift operation. The crane also includes a system for monitoring a load lifted by the telescoping boom. The system is configured to determine the current load lifted by the telescoping boom, receive pitch and/or roll information of the carrier unit from the slope sensor, adjust coordinates of the crane in a coordinate system based on the pitch and/or roll information, determine a transformed operating radius using the adjusted coordinates, and compare the load lifted to a rated capacity at the transformed operating radius.

According to another aspect, a system is provided for monitoring a load lifted by a crane, the crane having a carrier unit and a superstructure mounted on the carrier unit, the superstructure having a telescoping boom. The system includes a processor and a non-transitory computer-readable storage medium configured to store program instructions and the processor is configured is interpret and execute the program instructions to determine a load lifted by the telescoping boom, receive pitch and/or roll information of the carrier unit from a slope sensor disposed on the carrier unit, adjust coordinates of the crane in a coordinate system based on the pitch and/or roll information, determine a transformed operating radius using the adjusted coordinates, and compare the load lifted to a rated capacity at the transformed operating radius.

In another aspect, a method is provided for monitoring a load lifted by a crane. The crane includes a carrier unit having a chassis, tires connected to the chassis, a carrier deck and outriggers, a superstructure mounted on the carrier unit, the superstructure having a telescoping boom. The crane also includes a slope sensor operably connected to the carrier unit and configured to detect a pitch and/or a roll of the carrier unit during a lift operation. The method includes determining a load lifted by the telescoping boom, receiving pitch and/or roll information of the carrier unit, adjusting coordinate of the crane in a coordinate system based on the pitch and/or roll information, determining a transformed operating radius using the adjusted coordinate, and comparing the load lifted to a rated capacity at the transformed operating radius.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figure 1:
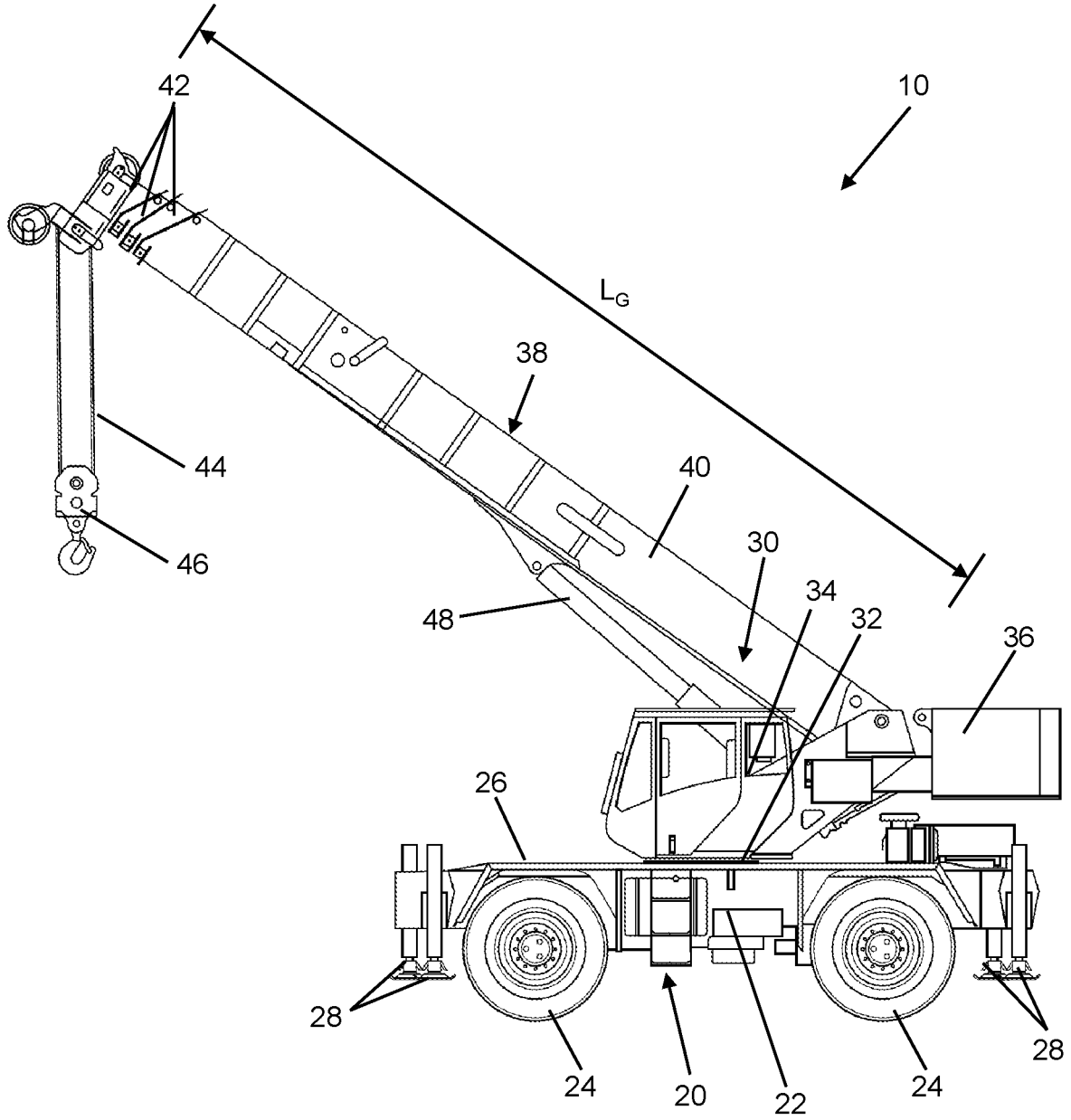
FIG. 1 is a side view of a crane according to an embodiment.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

Referring to FIG. 1, a crane 10 according to embodiments herein generally includes a carrier unit 20 and a superstructure 30 rotatably mounted on the carrier unit 20 and configured for rotation relative to the carrier unit 20. The carrier unit 20 includes various crane components, such as a chassis 22, one or more tires 24 connected to the chassis 22, a carrier deck 26 and outriggers 28. The chassis 22 supports the one or more tires 24, the carrier deck 26 and the outriggers 28, as well as other components such as a powertrain (not shown). The one or more tires 24 are configured for rolling engagement with the ground, a road, or similar support surface to facilitate rolling movement of the crane 10. For example, the powertrain may provide torque to the one or more tires 24 to propel the crane 10 for movement along the support surface. The carrier deck 26 generally defines an upwardly facing top surface of the carrier unit 20.

The outriggers 28 may be arranged in a deployed condition, in which the outriggers 28 are extended horizontally outward relative to the chassis 22 to one or more extension positions, and vertically to engage an underlying support surface. Continued vertical extension of the outriggers 28 may cause the outriggers 28 to lift the tires 24 from the support surface, such that the crane 10 is supported on the outriggers 28. The outriggers 28 may also be arranged in a retracted condition, in which the outriggers 28 are retracted horizontally inward toward the chassis 22 and vertically to disengage the support surface. Accordingly, in the retracted condition, the tires 24 may engage the support surface and the crane 10 may be supported on the tires 24. In an embodiment, horizontal extension and retraction of the outriggers may be accommodated by a telescoping box and arm assembly (not shown), and vertical extension and retraction may be accommodated by a jack (not shown) operably connected to the telescoping box and arm assembly, for example, at or near a distal end of the arm.

The superstructure 30 also includes various crane components, such as a rotating bed 32 rotatably mounted on the carrier unit 20, an operator's cab 34, a counterweight assembly 36 and a telescoping boom 38. The rotating bed 32 is rotatably mounted to the carrier unit 20 via a bearing structure and is configured to be driven in a first rotational direction, or alternatively, a second rotational direction opposite to the first rotational direction, about a generally vertical axis. The rotating bed 32 directly or indirectly supports the operator's cab 34, the counterweight assembly 36 and the telescoping boom 38, as well as other crane components such as one or more hoists (not shown), such that these components are rotatable in the first and second rotational directions with the rotating bed 32. The operator's cab 34 may include a user interface for allowing a crane operator to interact with a control system of the crane 10 as discussed further below, for example, to control operations of one or more crane components. The counterweight assembly 36 includes one or more weight units supported on a frame. The weight units may be installed and removed from the frame in a desired manner to provide a selected counterweight.

The telescoping boom 38 includes a base section 40 pivotably mounted on the rotating bed 32 for movement through a vertically oriented range of lift angles and one or more telescoping sections 42 configured for movement out of and into the base section 40 generally along a boom axis to change the boom length LG. One or more hoists (not shown) are configured to wind up and pay out a flexible member 44, such as a rope or cable. A lifting appliance 46, such as a hook block, is connected to a free end of the flexible member 44 and is suspended from a free end of the telescoping boom 38. A lift cylinder 48 is pivotably connected directly or indirectly between the base section 40 and the rotating bed 32. The lift cylinder 48 is operable to raise or lower the telescoping boom 38 through the range of lift angles. The rotating bed 32 is rotatable in the first and second rotational directions to cause rotation of the telescoping boom 38 through a range of horizontally oriented swing angles.

Figure 2:
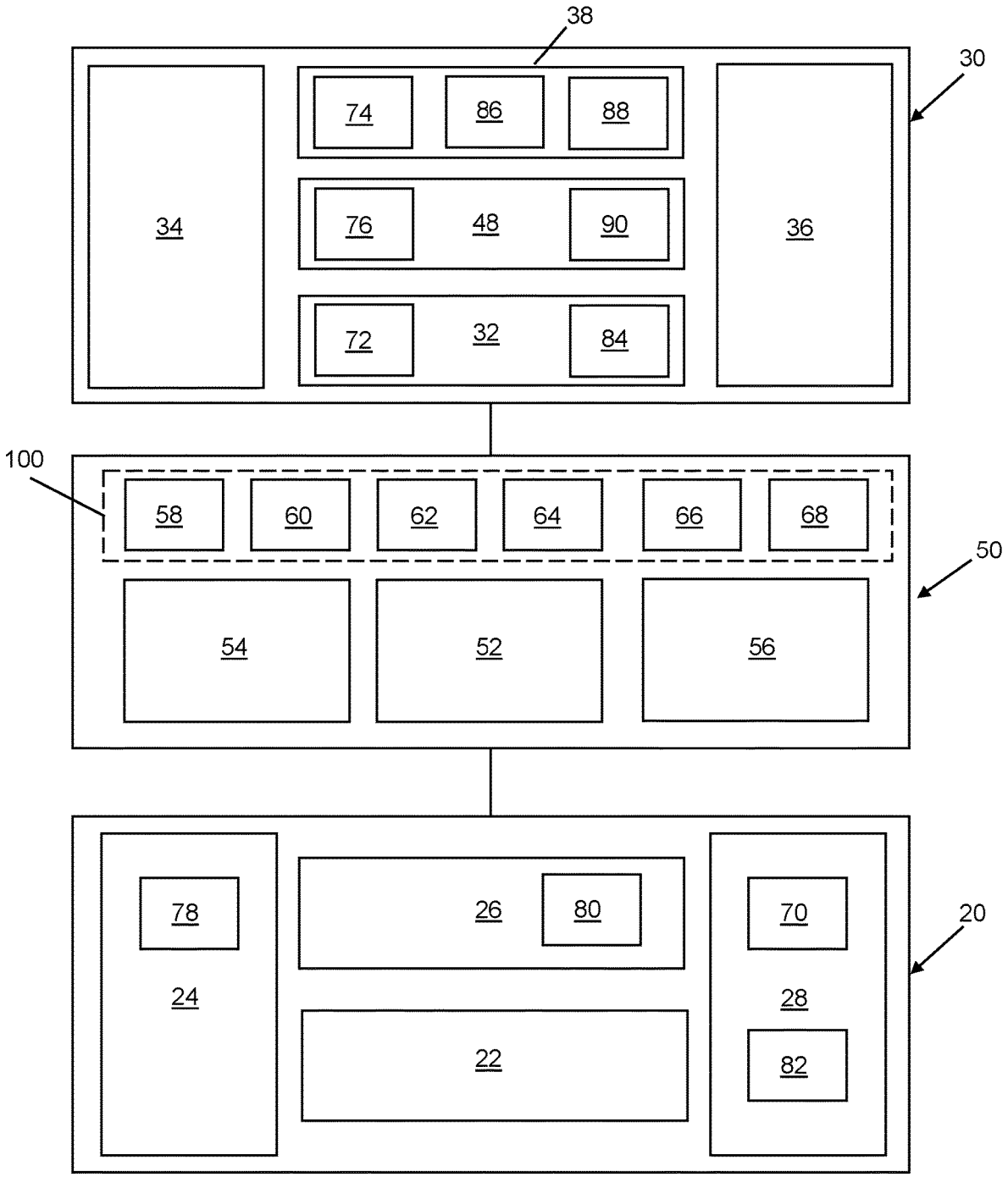
FIG. 2 is a schematic partial system diagram of the crane of FIG. 1 according to an embodiment.

Referring now to FIGS. 1 and 2, the crane 10 further includes a control system 50, sometimes referred to as a Crane Control System (CCS). The control system 50 may be implemented as one or more computing devices located at the crane 10, remote from and communicably connected to the crane 10, or a combination thereof. The control system 50 is operably connected to various crane components (including actuators of the crane components) of the carrier unit 20 and the superstructure 30 and may control operations of one or more of the crane components. For example, the control system 50 may control movements of one or more crane components, including starting, stopping, preventing and allowing movements of the crane component and/or controlling a speed, acceleration and/or deceleration of the crane component.

According to an embodiment, the control system 50 includes a crane controller 52, a rated capacity limiter (RCL) 54 and a working range limiter (WRL) 56. The crane controller 52 may be configured to send and/or receive control signals to various crane components to control movements of the crane components.

The RCL 54 is a system that generally operates to monitor a current load lifted (i.e., a hook load) by the telescoping boom 38 of the crane 10 relative to the rated capacity of the crane 10 at an operating radius (i.e., a hook radius). For example, the RCL 54 may determine the current load lifted and the operating radius based on information received from one or more crane sensors, user input, stored data and/or combinations thereof. The RCL 54 may identify a rated capacity at an operating radius, for example, from a stored load chart which includes rated capacities at different operating radii or lift angle and boom length combinations. The RCL 54 may compare the current load lifted by the crane to the rated capacity at the operating radius and control operations of one or more crane components based on the comparison. For example, the RCL 54 may control movements of the telescoping boom 38 (i.e., boom-up, boom-down, swing-left, swing-right, telescope-in and/or telescope-out movements) based on the comparison of the current load lifted to the rated capacity at the operating radius. In some embodiments, the RCL 54 may provide a control signal for controlling crane component movements directly to the crane component. In other embodiments, the RCL 54 may provide the control signal via the controller 52 to control movements of the crane component.

The WRL 56 is a system that generally operates to monitor a position of a crane component relative to a position of a restricted volume. For example, the WRL 56 may determine the position of the crane component based on information received from one or more crane sensors, user input, stored data and/or combinations thereof. The WRL 56 may identify the restricted volume, for example, based on stored position information, such as position information included in a worksite model, information received from one or more sensors (including crane sensors and/or external sensors communicably connected to the WRL 56), information received via user input and/or combinations thereof. The restricted volume may represent an obstacle, such as a building, at a worksite and define a volume in which operation of one or more crane components should be avoided. Accordingly, the WRL 56 may compare the crane component position information to the restricted volume position information and control operations of the crane component based on the comparison. For example, the WRL 56 may control movements of the telescoping boom 38 (i.e., boom-up, boom-down, swing-left, swing-right, telescope-in and/or telescope-out movements) based on the comparison of telescoping boom position information to the restricted volume position information. In some embodiments, the WRL 56 may provide a control signal for controlling crane component movements directly to the crane component. In other embodiments, the WRL 56 may provide the control signal via the controller 52 to control movements of the crane component.

The control system 50 further includes computer components 100, such as a processor 58, a memory device 60, a storage device 62, a communication device 64, an input device 66 and/or an output device 68 which may be connected to one another, for example, on a bus (not shown). In an embodiment, the computer components 100 may be operably connected to the controller 52, the RCL 54 and the WRL 56. However, it will be appreciated that the computer components 100 may be implemented in each of the controller 52, the RCL 54 and the WRL 56 or distributed among the controller 52, the RCL 54 and the WRL 56. It will be further appreciated that although shown independently, any of the controller 52, the RCL 54 and the WRL 56 may be integrated with another one or more of the controller 52, the RCL 54 and the WRL 56 and provided as a single unit configured to perform the operations of the individual components described above.

In an embodiment, the processor 58 may be a computer processor, such as a microprocessor, configured to interpret and execute program instructions. The processor 58 is further configured to effect various operations (including movements) of one or more crane components in response to executing the program instructions. For example, the processor 58 may cause the controller 52 to provide a control signal for controlling movements of the telescoping boom 38. It will be appreciated that the operations of the controller 52, the RCL 54 and the WRL 56 described herein may be carried out or otherwise effected by the processor 58 in response to executing program instructions.

The memory device 60 may be a non-transitory computer-readable storage medium configured to store information, such as the program instructions to be executed by the processor 58. The memory device 60 may be, for example, Random-Access Memory (RAM), Read-Only Memory (ROM) or other type of suitable memory device for storing information and/or executable program instructions. The storage device 62 is configured to store, for example, information, software, executable program instructions and the like which may, for example, be accessed or referenced by the processor 58. The storage device 62 may also store information collected during operation of the crane 10, such as information received by the control system 50 from one or more sensors or user input. In one embodiment, one or more load charts may be stored in the storage device 62 and/or memory device 60 and can be accessed or referenced, for example, by the RCL 54. The storage device 62 may be a non-transitory computer-readable storage medium and may include, for example, a hard disk and an associated drive and/or other similar, suitable storage devices and associated drives.

The communication device 64 is configured to transmit and/or receive information from/to the control system 50 and/or between components of the control system 50. For example, the communication device 64 may be provided as a communication interface having a transceiver or transceiver-like component to transmitting information to, and/or receiving information from, one or more other devices, such as other communication-enabled devices, components, sensors and the like.

The input device 66 may include, or form part of, a user interface configured to receive information from a user, such as the crane operator. The input device 66 may include, or be operably connected to, one or more operator controls by operation of which the user may provide information to the input device 66. The one or more operator controls may include, for example, a lever, joystick, knob, button, dial, switch, keyboard, keypad, pointer device, touch screen display, one or more sensors such as a biometric sensor, audio sensor, light sensor and the like, including various combinations thereof. The controller 52 may send a control signal to control movements of a crane component in response to information received by the input device 66.

The output device 68 may also include, or form part of, a user interface configured to provide information to a user, such as the crane operator. The output information may be provided visually, for example, on a display screen or with one or more lights (e.g., LEDs), audibly, for example by one or more audio speakers, and/or by way of haptic or vibratory feedback or alerts, for example, at an operator control. In some embodiments, the input device 66 and the output device 68 may be provided as a single device or include components provided as a single device, for example, a display screen or touch screen display. The output information may serve as an alert or an alarm.

The crane components may be operated to conduct various movements by controlling operations of corresponding component actuators. To this end, the control system 50 may be operably connected to one or more component actuators to control operations of the component actuators. For example, the control system 50 may be operably connected to outrigger actuators 70 for controlling movements (e.g., horizontal extension and retraction and vertical extension and retraction) of the outriggers 28; a rotating bed actuator 72 for controlling movements (e.g., rotation in the first and second rotational directions) of the rotating bed 32 to cause swing-left and swing-right movements of the telescoping boom 38 through the range of swing angles; a boom actuator 74 for controlling movements (e.g., telescope-out and telescope-in) of the telescoping sections 42 of the telescoping boom 38 to increase or decrease the boom length; and a lift cylinder actuator 76 for controlling movements (e.g., extension and retraction) of the lift cylinder 48 to cause boom-up and boom-down movements of the telescoping boom 38 through a range of lift angles.

Further, the control system 50 may be operably connected to one or more crane sensors configured to provide information to the control system 50 about the crane, a crane component, crane surroundings, the environment, atmospheric conditions (e.g., temperature, wind speed, and the like), and/or other information which may affect crane operations. The information may be provided as a parameter value or information from which a parameter value may be derived. In an embodiment, the crane sensors may include one or more tire sensors 78 configured to provide tire pressure information of one or more tires 24; one or more slope sensors 80 configured to provide slope information (e.g., pitch information and/or roll information) of the crane 10; one or more outrigger sensors 82 configured to provide outrigger extension and/or pressure/load information of the outriggers 28; one or more swing angle sensors 84 configured to provide swing angle information of the rotating bed 32 and/or the telescoping boom 38; one or more boom length sensors 86 configured to provide boom length information of the telescoping boom 38; one more lift angle sensors 88 configured to provide lift angle information of the telescoping boom 38; and one or more lift cylinder pressure sensors 90 configured to provide lift cylinder pressure information of the lift cylinder 48. Other sensors may be implemented as well, for example, a lift cylinder angle sensor for providing lift cylinder angle information to the control system 50, and/or additional flow, pressure, load, proximity sensors and the like. It will be appreciated that although FIG. 2 shows various crane sensors associated with particular crane components, the crane sensors may be mounted or positioned with different crane components suitable for providing the intended information described herein.

Figure 3:
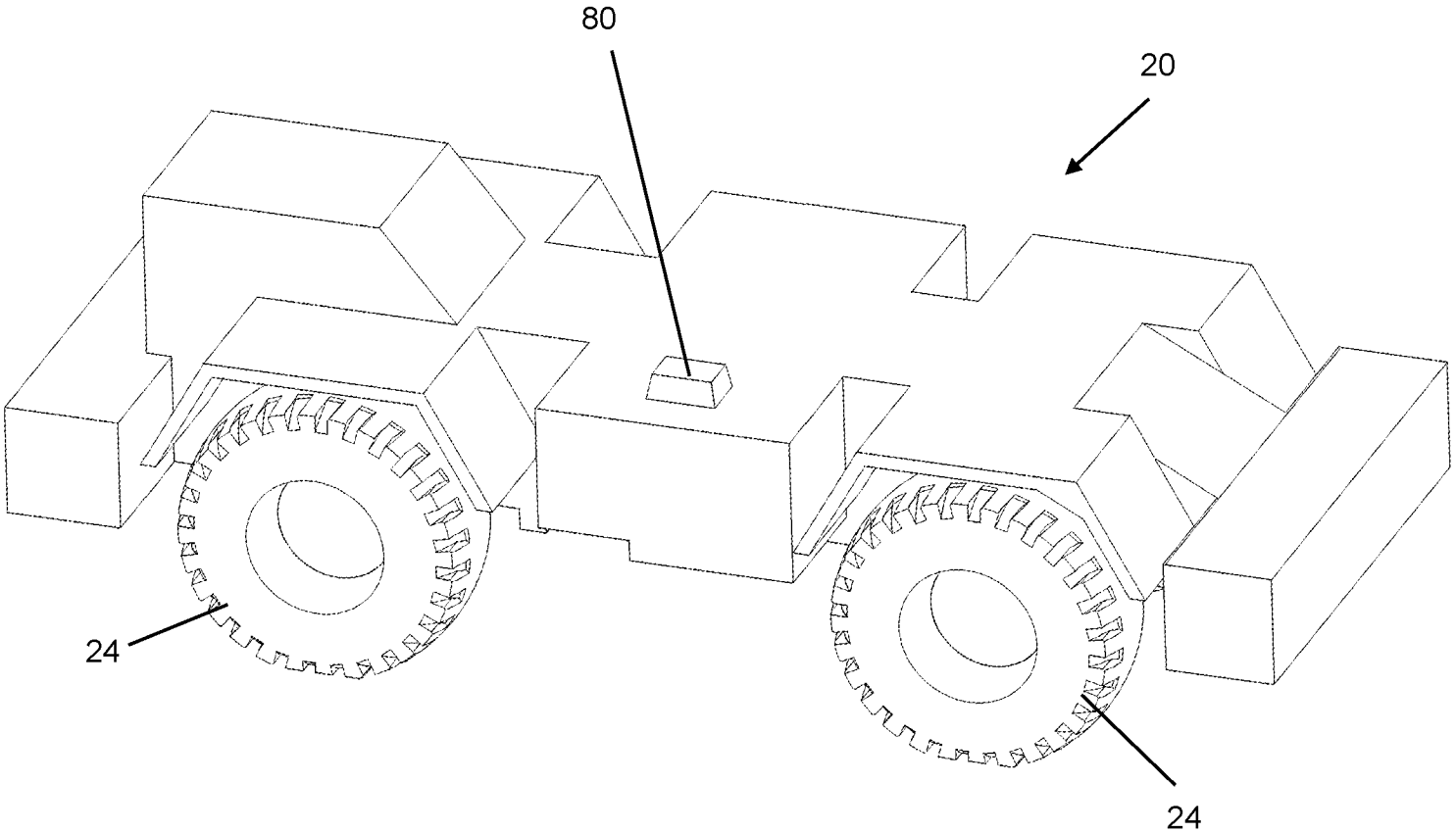
FIG. 3 is a perspective view of a carrier unit of a crane according to an embodiment.

Referring now to FIGS. 2 and 3, the RCL 54 may determine a current load lifted by the crane 10. In an embodiment, the RCL 54 may determine the load lifted by the crane 10 based, at least in part, on information received from one or more crane sensors. For example, the RCL may receive lift cylinder pressure information from the one or more lift cylinder pressure sensors 90 and determine the load lifted by the crane 10 based on the lift cylinder pressure information. In one embodiment, the RCL 54 may calculate the current load lifted based on a formulaic relationship between the lift cylinder pressure and the current load lifted. Alternatively, or in addition, the RCL 54 may retrieve the current load lifted from the memory device 60 or storage device 62 based on known load values corresponding to different lift cylinder pressures or based on user input information, for example, when the load is known.

The RCL 54 may also determine an operating radius of the current load lifted by the crane 10 based, at least in part, on information received from one or more crane sensors. For example, the RCL 54 may receive lift angle information from one or more lift angle sensors 88 and boom length information from one or more boom length sensors 86 and determine the operating radius based on the lift angle information and the boom length information. In one embodiment, the RCL 54 may calculate the operating radius based on formulaic relationship between the lift angle, boom length and operating radius. Alternatively, or in addition, the RCL 54 may retrieve the operating radius from the memory device 60 or storage device 62 based on known operating radii values corresponding to different lift angles and boom lengths.

The operating radius of the load lifted by the crane 10 may further be determined based on a pitch and/or roll of the crane 10. The pitch of the crane 10 generally refers to rotation of the carrier unit 20 (e.g., chassis 22, carrier deck 26) and/or rotating bed 32 about an axis extending laterally across the crane 10. Thus, the pitch of the crane 10 results in an upward or downward deflection of a front end or a rear end of the carrier deck 26. The roll of the crane 10 generally refers to rotation of the carrier unit 20 (e.g., chassis 22, the carrier deck 26) and/or the rotating bed 32 about an axis extending longitudinally along the crane 10. Thus, the roll of the crane 10 results in an upward or downward deflection of the left or right lateral sides of the carrier deck 26. The RCL 54 may receive pitch information and roll information (referred to collectively as "slope information") from one or more crane sensors. For example, the RCL 54 may receive information regarding deflection of the carrier unit 20 at different locations from one or more crane sensors and may then calculate slope information based on information regarding deflection of the carrier unit 20.

The control system 50 (including the RCL 54) may receive slope information from one or more slope sensors 80, mounted on the carrier unit 20, for example, the chassis 22 or carrier deck 26, or on the superstructure 30, for example, on the rotating bed 32. During movement of the outriggers 28 to the deployed condition, such that the tires 24 are lifted from the support surface and the crane 10 is supported on the outriggers 28, the slope sensor 80 may provide pitch and roll information to the control system 50 to allow for leveling of carrier unit 20, for example, the carrier deck 26. For example, the control system 50 may control vertical extension of one or more outriggers 28 to effect a change in pitch and/or roll of the carrier deck 26 until the carrier deck 26 is substantially level. The crane 10 may perform a lift operation with the outriggers 28 deployed. During such a lift operation, pitch and/or roll of the carrier deck 26 is expected to be relatively small and may not substantially affect the operating radius.

However, in some scenarios, it may be beneficial or permissible to perform a lift operation with the outriggers 28 in the retracted condition, such that the crane 10 is supported on the tires 24. Such a lift operation is commonly referred to as an "on-rubber" lift operation. Generally, during an on-rubber lift operation, the carrier deck 26 is expected to pitch and/or roll to a greater extent than during a lift operation performed with deployed outriggers 28, due to deformation of the tires 24. Pitch and/or roll of the crane 10 during the on-rubber lift operation may cause an increase in operating radius, and consequently, may cause a decrease in the rated capacity (i.e., maximum permissible load at an operating radius).

According to embodiments herein, the RCL 54 is configured to determine an operating radius further based, at least in part, on the slope information (i.e., pitch information and/or roll information). In one embodiment, the slope information may be received by the RCL 54 from the slope sensor 80. The RCL 54 may monitor the current load lifted at the operating radius determined based at least in part on the slope information. For example, the RCL 54 may compare the current load lifted to a rated capacity of the of the crane 10 at the operating radius determined based at least in part on the slope information. Further still, the RCL 54 may control operations of one or more crane components, such as the telescoping boom 38, based on the comparison of the current load lifted to the rated capacity at the operating radius determined based at least in part on the slope information. For example, the RCL 54 may reduce or limit a speed, and/or prevent or limit movement of the telescoping boom 38 in a direction which may cause the rated capacity to approach the current load lifted, within a predetermined threshold.

Figure 4:
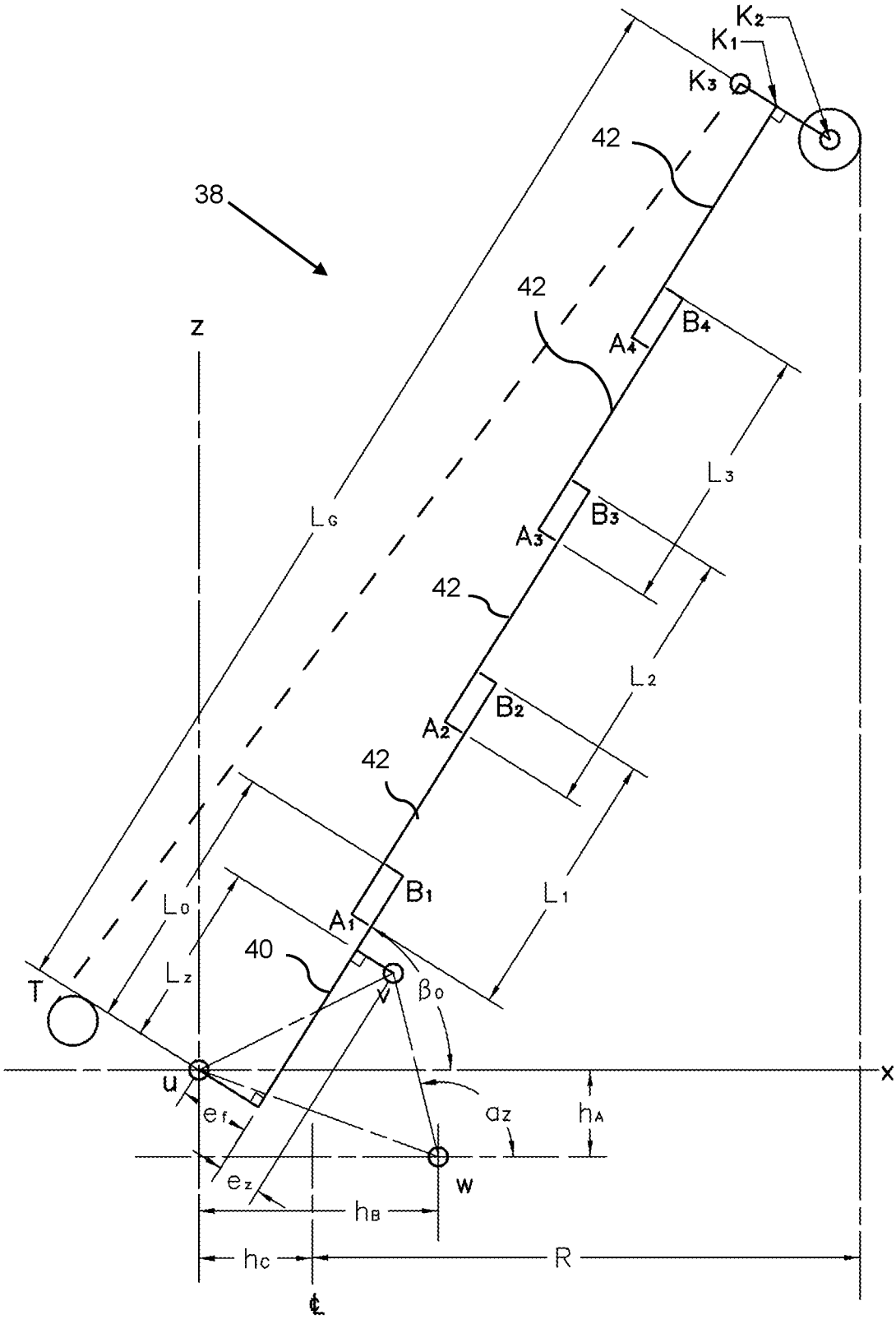
FIG. 4 is a diagram showing a geometric layout of a telescoping boom according to an embodiment.
Figure 5:
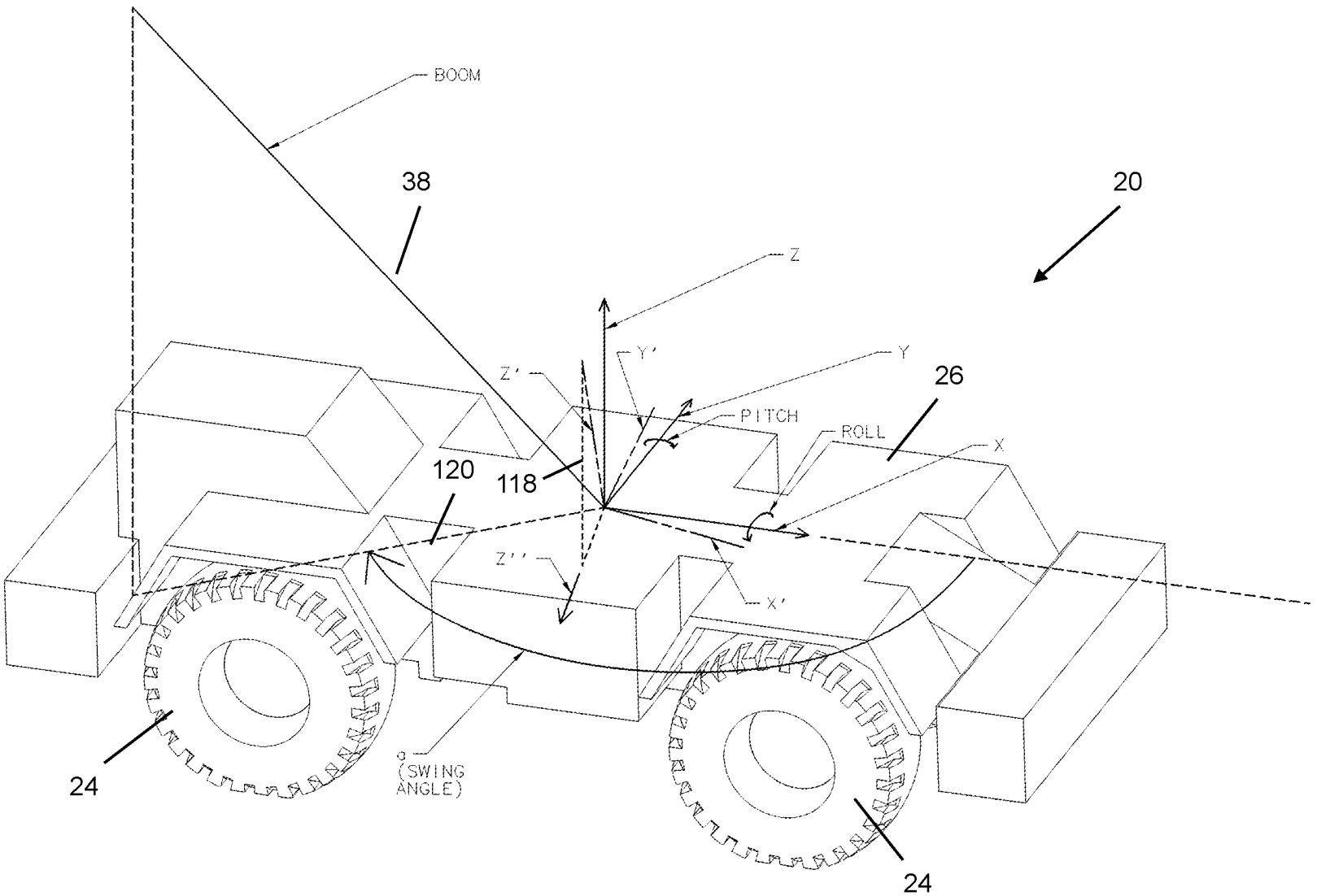
FIG. 5 is another perspective view of a carrier unit of a crane according to an embodiment.

With reference to FIGS. 4 and 5, the RCL 54 is configured to provide a coordinate system XYZ for the carrier unit 20. The RCL 54 may determine coordinates for a plurality of points in the coordinate system XYZ. For example, the RCL 54 may determine X and Z coordinates for three points u, v, w in the coordinate system XYZ which may correspond to predetermined points on the crane 10 as shown in FIG. 4. For example, point 'u' may correspond to a base pivot axis of the telescoping boom 38 and may serve as an origin for the coordinate system XYZ. Points 'v' and 'w' may also correspond to points in a geometric layout of the telescoping boom 38. For example, point 'v' may correspond to a pivot axis formed by a connection of the lift cylinder 48 to the base section 40 of the boom 38, and point 'w' may correspond to a base pivot axis of the lift cylinder 48.

Figure 6:
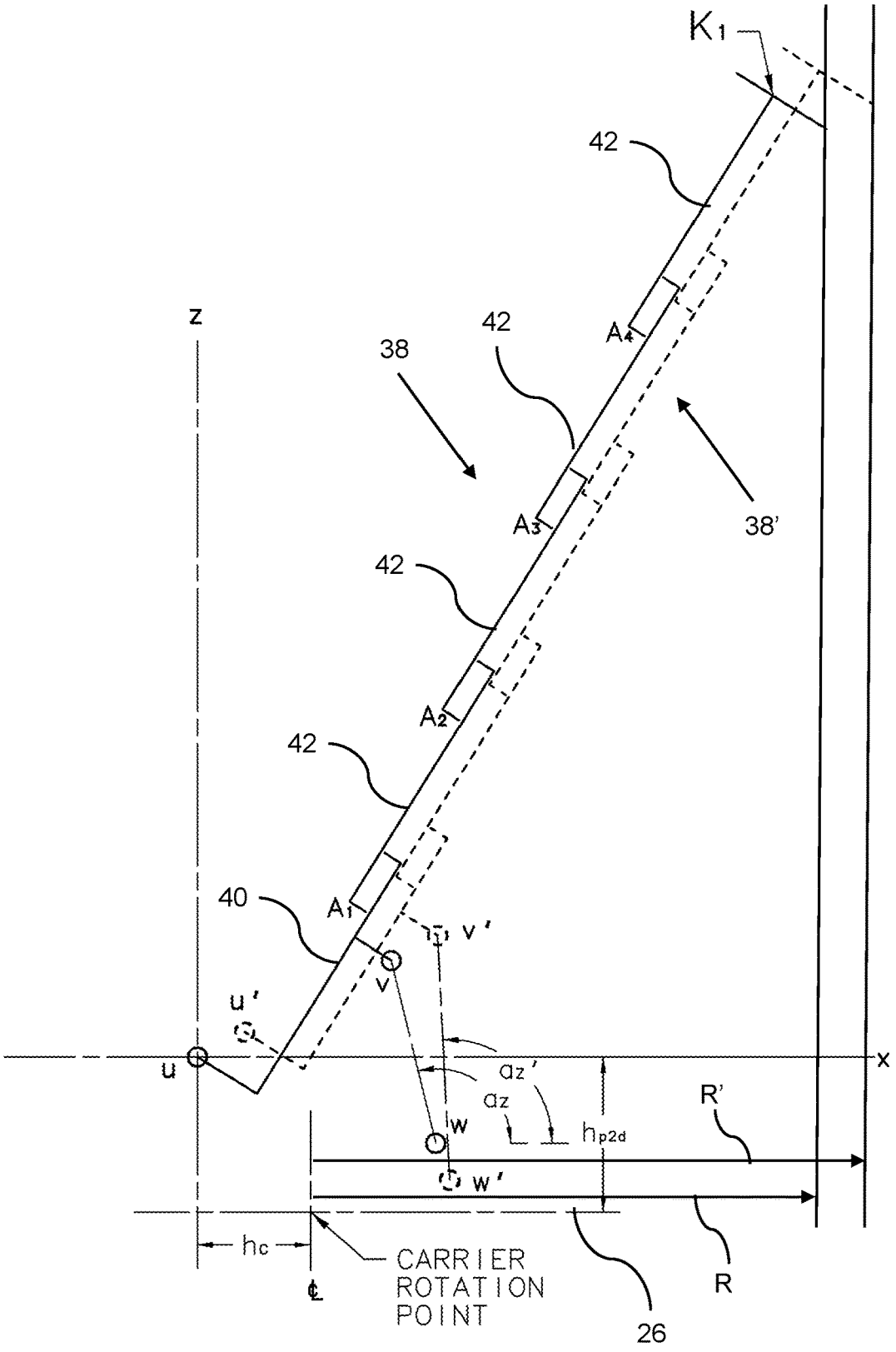
FIG. 6 is a diagram showing a geometric layout of a portion of a telescoping boom and a crane carrier unit according to an embodiment.

Referring to FIGS. 4 and 6, the RCL 54 may transform the coordinates based on the slope information. For example, the RCL 54 may determine a lean angle of the crane 10, such as a lean angle of the carrier unit 20, based on the slope information. In an embodiment, the lean angle may be determined based on a pitch angle and a roll angle, which may be determined based on the slope information. The coordinates may be adjusted using the lean angle. A lean angle for the actual position of the telescoping boom 28 may be determined as well. With a known lean angle, the coordinate transformations may account for the pitch and the roll of the crane 10 about a point on the carrier unit 20.

General coordinates of points located on the telescoping boom 38, or related components (e.g., the lift cylinder 48) may be translated to have the carrier unit 20 rotation point (i.e., the point on the carrier unit 20 about which the carrier unit 20 pitches and/or rolls) as the origin of the coordinate system. The coordinates may be rotated about the Y-axis using the lean angle. The coordinates may then be translated back to have the origin at the original location, i.e., at the base pivot axis (point 'u') of the telescoping boom 38. Such operations may be performed by the RCL 54.

Figure 7:
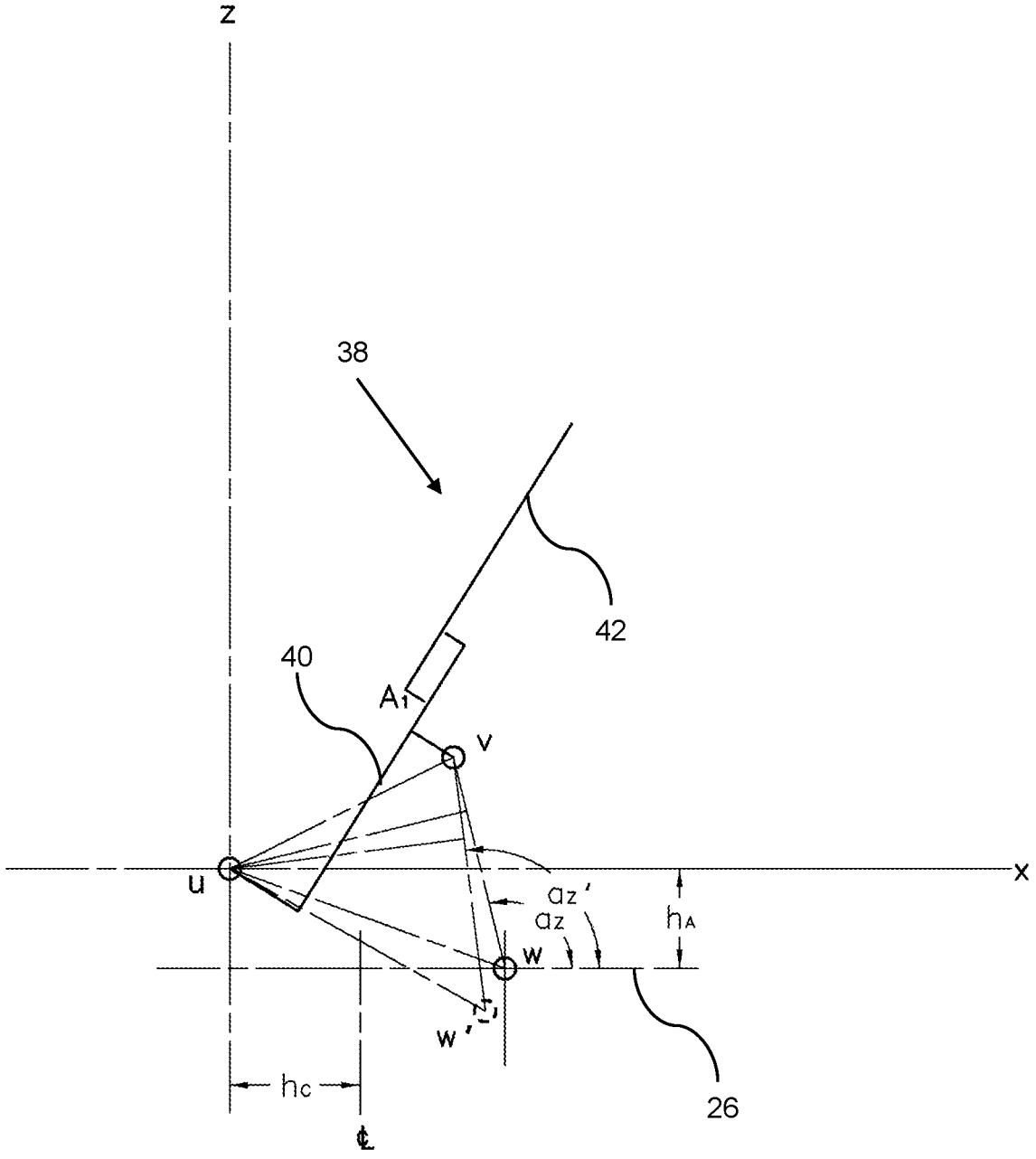
FIG. 7 is another diagram showing a geometric layout of a portion of a crane boom and a crane carrier according to an embodiment.

Alternatively, with reference to FIG. 7, the RCL 54 may transform the coordinates of the of the points using a rotational coordinate system transformation for the base pivot axis (at point 'u') of the telescoping boom 38. Thus, the base pivot axis of the telescoping boom 38 may remain at the origin of the coordinate system. However, the reference point 'w' does shift and the lift cylinder angle is altered.

Accordingly, in the embodiments above, the RCL 54 may determine an adjusted, or transformed operating radius based on the slope information, such that the transformed operating radius takes into account a pitch and/or roll of the crane 10, for example, during an on-rubber lift operation.

The RCL 54 may additionally be configured to store, for example, crane geometry information, crane weight information, or both, and may use such information to determine the transformed operating radius. For example, the crane geometry information may be used by the RCL 54 to create a geometric model of the crane 10 or a crane component, such as the telescoping boom 38. The crane geometry information may include, for example, various dimensions, distances between components, coordinate system information, coordinate information of reference points and/or crane components, and the like. The crane geometry information may be provided, for example, based on sensor information and/or user input. Weight information may include, for example, a weight profile of the crane 10, a weight of the load lifted by the crane, weights of various crane components and the like.

Referring again to FIG. 4, a geometric layout of the telescoping boom 38 in XZ plane of an XYZ coordinate system includes the reference points 'u', 'v' and 'w.' In addition, the telescoping sections 42 are shown each having a first end $A_1, A_2 \ldots A_i$ at a proximal end and a second end $B_2, B_3 \ldots B_{i+1}$ at a distal end. A length $L_1, L_2 \ldots L_i$ of each telescoping section 42 is the distance between the second end $B_2, B_3 \ldots B_{i+1}$ and the first end $A_1, A_2 \ldots A_i$ of the respective telescoping sections 42. The base section 40 is shown having a second end $B_1$ at a distal end and having a length $L_0$. In addition, a length of the base section 40 to the pivot connection axis at reference point 'v' is shown as $L_z$. A length of the telescoping boom 38 is shown as $L_G$. A lift angle of the telescoping boom 38 is shown as $\beta_0$. A lift cylinder angle is shown as $\alpha_z$.

Accordingly, with further reference to FIG. 4, the following coordinates may be determined:

$X_u=0$, where:

$X_u$: Horizontal (x-axis) position of the reference point 'u';

$X_w=h_B$, where:

$X_w$: Horizontal (x-axis) position of the reference point 'w'; and $h_B$: Horizontal distance between the reference point 'u' and the reference point 'w'; and $X_v=L_z\cdot\cos\beta_0+(e_z+e_f)\cdot\sin\beta_0$, where:

$X_v$: Horizontal (x-axis) position reference point 'v';

$L_z$: Length of the base section 40 from the origin to the reference point 'v';

$\beta_0$: Lift angle of the telescoping boom 38;

$e_z$: Perpendicular distance between reference point 'v' and the base section 40 of the telescoping boom 38; and $e_f$: Perpendicular distance between the base section 40 the telescoping boom 38 and the reference point 'u'.

Still referring to FIG. 4, the following 'Z' coordinates are determined:

$Z_u=0$, where:

$Z_u$: Vertical (Z-axis) position of the reference point 'u';

$Z_w=-h_A$, where:

$Z_w$: Vertical (Z-axis) position of the reference point 'w'; and $h_A$: Vertical distance between the reference point 'u' and the reference point 'w'; and $Z_v=L_z\cdot\sin\beta_0\cdot(e_z+e_f)\cdot\cos\beta_0$, where:

$Z_v$: Vertical (Z-axis) position of the reference point 'v';

According to an embodiment, the lift cylinder angle $\alpha_z$ may be determined as:

$$\text{If } X_v > X_w: \alpha_Z = \tan^{-1}\left(\frac{Z_v - Z_w}{X_v - X_w}\right)$$

$$\text{If } X_w > X_v: \alpha_Z = \pi - \tan^{-1}\left(\frac{Z_v - Z_w}{X_w - X_v}\right)$$

FIG. 5 is another perspective view of the carrier unit 20 according to an embodiment. In FIG. 5, the carrier unit 20 may be oriented in the first coordinate system XYZ. In an embodiment, the roll angle convention may be based on a right-handed positive direction of the carrier X-axis direction. A positive roll angle may lower the right-handed side of the crane and raise the left-handed side of the crane. A positive pitch angle may be based on the right-handed positive direction for the carrier Y-axis direction. A positive pitch angle may lower the front of the carrier unit 20 and may raise the rear of the carrier unit 20. The X and Z coordinates may correspond to a midplane of the telescoping boom 38.

A lean angle may be determined to adjust the coordinates in the first coordinate system XYZ, such as the X, Z coordinates in the midplane of the telescoping boom 38. A unit vector near the X axis direction ("X unit vector") based on the effect of the pitch angle may be determined. A unit vector near the Y axis direction ("Y unit vector") based on the effect of the roll angle may be determined as well. A maximum lean angle may be determined from a Z unit vector based on the X unit vector and the Y unit vector. The maximum lean angle may then be determined based on the Z unit vector.

The lean angle may be identified as:

$\omega_L$

The X unit vector may be identified as:

$$\hat{X}' = \begin{vmatrix} \cos\omega_P \\ 0 \\ -\sin\omega_P \end{vmatrix},$$

where:

$\omega_p$: Pitch angle

The Y unit vector may be identified as:

$$\hat{Y}' = \begin{vmatrix} 0 \\ \cos\omega_R \\ \sin\omega_R \end{vmatrix},$$

where:

$\omega_R$: Roll angle

The maximum lean angle may be determined from the following vector:

$$\vec{Z}' = \hat{X}' \times \hat{Y}'$$

The maximum lean angle may then become the following:

$$\omega \cos^{-1}(\hat{Z}' \cdot \hat{k})_{L,max}$$

The Z unit vector may be projected to the XY plane as a projected Z unit vector 118 (see FIG. 5). A projection 120 of the telescoping boom 38 to the XY plane may be determined based a swing (or slew) angle of the telescoping boom 38. The lean angle for the actual position of the telescoping boom 38 may then be determined based on the maximum lean angle, the projected Z unit vector 118 and the projected boom 120 in the XY plane.

The projection 118 of the Z unit vector to the XY plane may be determined as follows:

$$\vec{Z}'' = \begin{vmatrix} \vec{Z}'x \\ \vec{Z}'y \\ 0 \end{vmatrix}$$

The projection 120 of the telescoping boom 38 to the XY plane may be determined as follows:

$$\hat{B} = \begin{vmatrix} \cos\alpha \\ -\sin\alpha \\ 0 \end{vmatrix},$$

where:

$\alpha$: Swing angle

The lean angle for the actual position of the telescoping boom 38 may then become the following:

$$\omega_L = \omega(\hat{Z}'' \cdot \hat{B})_{L,max}$$

Referring now to FIG. 6, with the lean angle known, coordinate transformations may be used to account for the pitch and roll of the carrier unit 20 (and the crane 10). The crane 10 may rotate about a point on the carrier unit 20, for example, at a horizontal distance $h_c$ from the Z-axis. The point may be shown at a vertical distance ($h_{p2d}$ in FIG. 6). In one embodiment, the vertical distance may correspond to the distance from the base pivot axis 'u' of the telescoping boom 38 to the carrier deck 26. The telescoping boom base section 40 elevation angle may be preserved when accounting for the lean effects because a separate sensor may be used to detect the elevation angle. Point 'v' may be a position of the boom, and not the turntable. The base pivot axis at point 'u' would shift. Thus, adjusted coordinates may then be determined.

The coordinates may be adjusted as follows:

$$X_v = X_u + L_z \cdot \cos\beta_0 + (e_z + e_f) \cdot \sin\beta_0$$

$$Z_v = Z_u + L_z \cdot \sin\beta_0 - (e_z + e_f) \cdot \cos\beta_0$$

$$X_{A1} = X_u + (L_0 - e_1) \cdot \cos\beta_0 + e_f \cdot \sin\beta_0$$

$$X_{B1} = X_u + L_0 \cdot \cos\beta_0 \cdot e_f \cdot \sin\beta_0$$

$$Z_{A1} = Z_u + (L_0 - e_1) \cdot \sin\beta_0 \cdot e_f \cdot \cos\beta_0$$

$$Z_{B1} = Z_u + L_0 \cdot \sin\beta_0 - e_f \cdot \cos\beta_0$$

In an embodiment, a general coordinate of a point on the boom system may have X and Z coordinates. The coordinates may be translated to have the carrier rotation point (see FIG. 6) as the origin based on the general coordinate of a point on the telescoping boom system and the coordinate for the carrier rotation point. The coordinates may be rotated about the Y-axis based on the lean angle and the translated coordinates. The coordinates may then be translated back to have the origin at the original locations, i.e., where the boom base pivot axis 'u' originally was.

The following may indicate the general coordinate of a point on the boom system:

$\vec{R}$

The coordinates may be translated to have the carrier rotation point as the origin, in the following manner:

$\vec{R}' = \vec{R} = \vec{R}_{rot}$, where:

$$\vec{R}_{rot} = \begin{vmatrix} h_c \\ 0 \\ -h_{lean} \end{vmatrix}$$

The coordinates may be rotated about the Y-axis using the following (the lean angle calculated earlier may utilized):

$$\vec{R}'' = \vec{R}' \cdot \begin{vmatrix} \cos\omega_L & 0 & \sin\omega_L \\ 0 & 1 & 0 \\ -\sin\omega_L & 0 & \cos\omega_L \end{vmatrix}$$

The coordinates may be translated back to have the origin at the original locations (where the boom pivot originally was) as follows:

$$\vec{R}''' = \vec{R}'' + \vec{R}_{rot}$$

With further reference to FIG. 6, coordinates of the telescoping boom 38 may be transformed in manner described above, and the transformed telescoping boom 38' is shown in broken lines, taking into account the slope information. In addition, the transformed operating radius is shown at R', while the original operating radius is shown at R. The transformed reference points u', v' and w' are shown in FIG. 6 taking into account the slope information. In an on-rubber lifting operation, the RCL 54 may measure an operating radius from a center line of rotation of the superstructure, which may have shifted in response to a pitch and/or roll of the carrier unit 20. The RCL 54 may determine the operating radius during an on-rubber lifting operation in the manner described above. For example, the coordinates of different points on the crane may be adjusted to account for a pitch and/or roll of the carrier unit 20.

FIG. 7 is a diagram showing a geometric layout of a portion of the telescoping boom 38 and the carrier unit 20 according to an embodiment. With reference to FIG. 7, another approach to account for the lean during an on-rubber lifting operation may be to use a rotational coordinate system transformation for the boom pivot. In such an approach, the boom pivot remains at the origin. However, point 'w' does shift and the angle $\alpha_z$ is altered. The change in angle may affect the FBD of the boom system that it may be seen to improve predicted values.

Figure 8:
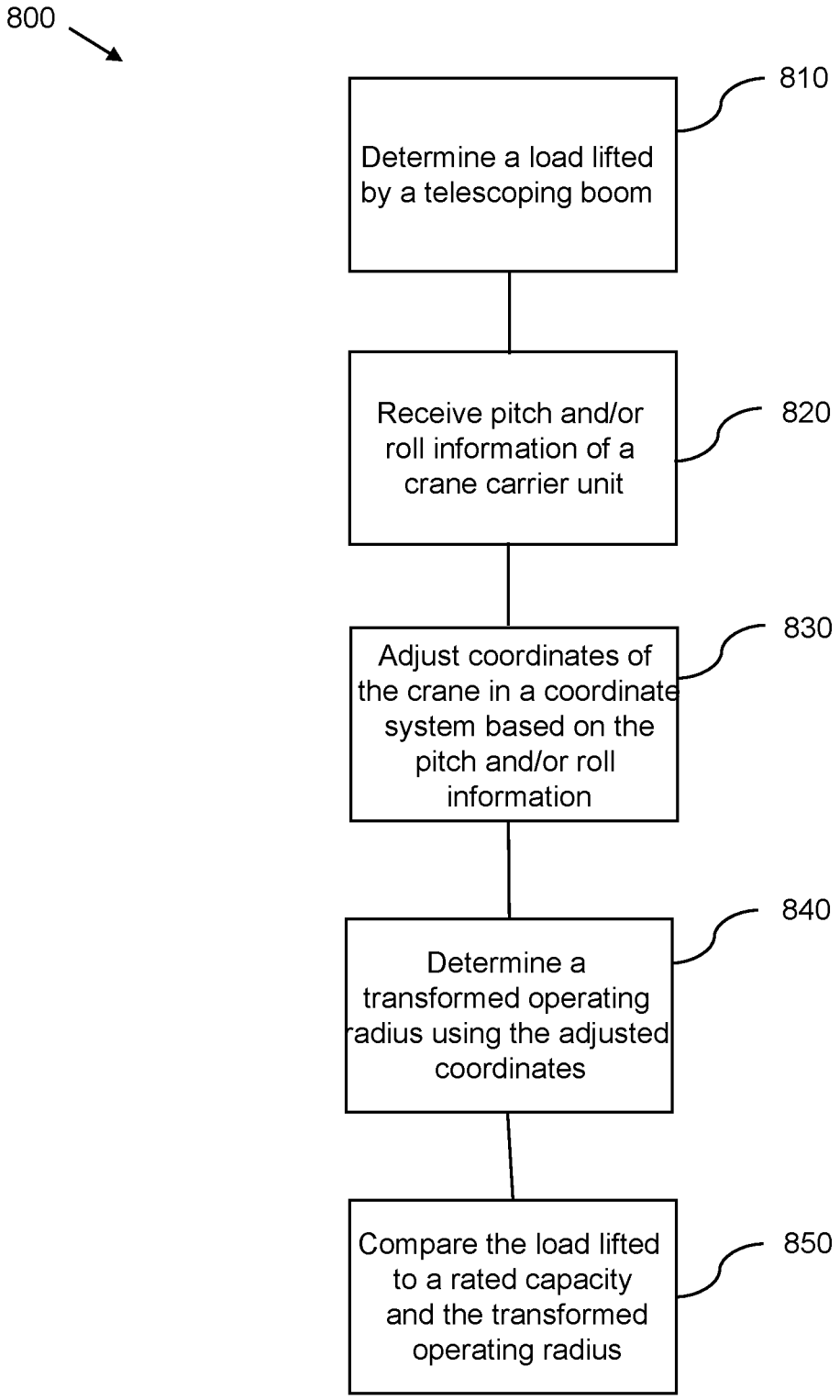
FIG. 8 is a block diagram showing a method for monitoring a crane according to an embodiment.

Referring to FIG. 8, according to an embodiment, a method 800 for monitoring a load lifted by a crane may include, at 810, determining a load lifted by a telescoping boom 38 of the crane 10, at 820, receiving pitch and/or roll information of a carrier unit 20 of the crane 10, for example, from a slope sensor 80, and at 830, adjusting coordinates of the crane 10 in a coordinate system based on the pitch and/or roll information. At 840, the method may further include determining a transformed operating radius R' using the adjusted coordinates, and at 850, comparing the load lifted to a rated capacity at the transformed operating radius R'.

Accordingly, in the embodiments above, the RCL 54 may determine an operating radius (also referred to as a transformed operating radius R') of a crane 10, for example, during an on-rubber lift operation using pitch and/or roll information, i.e., slope information, received from the slope sensor 80. In one embodiment, the transformed operating radius R' may refer to an operating radius R that has been adjusted to account for pitch and/or roll of the crane 10. The pitch and/or roll information may be indicative of a pitch and/or roll of the carrier unit 20. The pitch and/or roll information may also be indicative of a pitch and/or roll of the superstructure 30.

The RCL 54 may transform coordinates of the crane 10 based on the pitch and/or roll information from the slope sensor 80, to account for the pitch and/or roll of the crane 10. By accounting for the pitch and/or roll of the crane 10, the RCL 54 may determine the transformed operating radius of the crane 10 during, for example, an on-rubber lift operation.

In the manner above, the RCL 54 may monitor the load lifted by the crane 10 and determine the operating condition (for example a load utilization) of the crane 10 during the on-rubber lifting operation based on a comparison of the load lifted by the crane 10 to the rated capacity at the transformed operating radius R'. That is, the RCL 54 may use an operating radius determined based on the pitch and/or roll information received from the slope sensor 80 to monitor the load lifted by the crane 10 and determine the operating condition of the crane.

It is understood that the relative directions described above, e.g, "upward," "downward," "upper," "lower," "above," "below," are used for illustrative purposes only and may change depending on an orientation of a particular component. Accordingly, this terminology is non-limiting in nature. In addition, it is understood that one or more various features of an embodiment above may be used in, combined with, or replace other features of a different embodiment described herein.

All patents referred to herein, are hereby incorporated herein in their entirety, by reference, whether or not specifically indicated as such within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

The invention claimed is:

1. A crane comprising:

a carrier unit having a chassis, tires connected to the chassis, a carrier deck and outriggers, the outriggers movable to a deployed condition in which the outriggers engage an underlying support surface and lift the tires from the support surface such that the outriggers support the carrier unit, and a retracted condition in which the outriggers are disengaged from the support surface and the tires are engaged with the support surface, such that the tires support the carrier unit;

a superstructure mounted on the carrier unit, the superstructure comprising a telescoping boom;

a slope sensor operably connected to the carrier unit and configured to detect a pitch and/or a roll of the carrier unit during a lift operation; and a system for monitoring a load lifted by the telescoping boom, the system configured to:

determine the current load lifted by the telescoping boom;

receive pitch and/or roll information of the carrier unit from the slope sensor, the pitch and/or roll information including the detected pitch and/or roll of the carrier unit;

adjust coordinates of the crane in a coordinate system based on the pitch and/or roll information;

determine a transformed operating radius using the adjusted coordinates; and compare the current load lifted to a rated capacity at the transformed operating radius, wherein the system is configured to monitor the current load lifted with the outriggers in the retracted condition.

2. The crane of claim 1, wherein the system is configured to control one or more movements of the telescoping boom based on the comparison of the current load lifted to the rated capacity at the transformed operating radius.

3. The crane of claim 1, wherein the system is configured to receive boom length information from a boom length sensor and lift angle information from a lift angle sensor.

4. The crane of claim 1, wherein the system stores one or more load charts and the rated capacity at the transformed operating radius is determined from a load chart of the one or more load charts.

5. The crane of claim 1, wherein the system is further configured to determine a lean angle of the carrier unit using the pitch and/or roll information and further uses the lean angle to adjust the coordinates of the crane in the coordinate system.

6. A system for monitoring a load lifted by a crane, the crane comprising a carrier unit, a slope sensor mounted on the carrier unit configured to detect a pitch and a roll of the carrier unit, and a superstructure mounted on the carrier unit, the superstructure comprising a telescoping boom, the system comprising:

a processor and a non-transitory computer-readable storage medium configured to store program instructions and the processor is configured is interpret and execute the program instructions to:

determine a load lifted by the telescoping boom;

receive slope information of the carrier unit from the slope sensor, the slope information including the detected pitch and roll of the carrier unit;

determine a lean angle of the carrier unit using the slope information;

transform coordinates of the crane in a coordinate system using the lean angle to account for the pitch and roll of the carrier unit;

determine a transformed operating radius using the transformed coordinates; and compare the load lifted to a rated capacity at the transformed operating radius.

7. The system of claim 6, further configured to control movements of the telescoping boom based on the comparison of the load lifted to the rated capacity at the transformed operating radius.

8. A method for monitoring a load lifted by a crane, the crane comprising a carrier unit having a chassis, tires connected to the chassis, a carrier deck and outriggers, the outriggers movable between retracted and deployed conditions, a superstructure mounted on the carrier unit, the superstructure comprising a telescoping boom, and a slope sensor operably connected to the carrier unit and configured to detect a pitch and/or a roll of the carrier unit during a lift operation, the method comprising:

determining a load lifted by the telescoping boom;

receiving pitch and/or roll information of the carrier unit during a lift operation with the outriggers in the retracted condition such that the carrier unit is supported on the tires, wherein the pitch and/or roll information includes the detected pitch and/or roll of the carrier unit;

adjusting coordinates of the crane in a coordinate system based on the pitch and/or roll information;

determining a transformed operating radius using the adjusted coordinates; and comparing the load lifted to a rated capacity at the transformed operating radius.

9. A crane comprising:

a carrier unit;

a plurality of tires connected to the carrier unit;

a plurality of outriggers connected to the carrier unit, the outriggers movable between a retracted condition in which the carrier unit is supported on ground by the plurality of tires and a deployed condition which the carrier unit is supported on ground by the outriggers;

a superstructure mounted on the carrier unit, the superstructure comprising a telescoping boom;

a slope sensor operably connected to the carrier unit configured to detect a slope of the carrier unit; and a system for monitoring the crane, the system configured to:

receive slope information from the slope sensor, the slope information including the detected slope of the carrier unit;

determine an operating radius of the telescoping boom using the slope information with the outriggers in the retracted condition; and control vertical extension of the outriggers based on the slope information during movement of the outriggers to the deployed condition for leveling the carrier unit.

10. The crane of claim 9, wherein the determined operating radius takes into account the pitch and the roll of the carrier unit due to deformation of the tires during a lift operation.

* * * * *